US005832353A

United States Patent [19]

Sano

[11] Patent Number: 5,832,353

[45] Date of Patent: Nov. 3, 1998

[54] BELT-TYPE FIXING DEVICE

[75] Inventor: Eiichi Sano, Takatsuki, Japan

[73] Assignee: Minolta Co., Ltd., Osaka, Japan

[21] Appl. No.: 845,490

[22] Filed: Apr. 25, 1997

[30] Foreign Application Priority Data

Apr. 26, 1996 [JP] Japan ..... 8-106850

[51] Int. Cl.[6] ..... G03G 15/20

[52] U.S. Cl. ..... 399/329; 399/331

[58] Field of Search ..... 399/320, 328, 399/329, 68; 347/153, 154, 156; 219/216, 469, 619

[56] References Cited

U.S. PATENT DOCUMENTS

| | | | |
|---|---|---|---|
| 5,053,829 | 10/1991 | Field et al. | 355/290 |
| 5,257,078 | 10/1993 | Kuroda | 399/329 |
| 5,436,712 | 7/1995 | Wayman et al. | 399/328 |
| 5,614,999 | 3/1997 | Kanesawa et al. | 399/329 |

FOREIGN PATENT DOCUMENTS

| | | |
|---|---|---|
| 4-199170 | 7/1985 | Japan . |
| 4-27989 | 1/1992 | Japan . |
| 60-104852 | 7/1992 | Japan . |
| 06-19344 | 1/1994 | Japan . |

*Primary Examiner*—Arthur T. Grimeley
*Assistant Examiner*—Hoan Tran
*Attorney, Agent, or Firm*—McDermott, Will & Emery

[57] ABSTRACT

A belt-type fixing device includes a rotatably supported endless belt and a outer roller arranged outside the belt in contact therewith. Arranged inside the belt are a heater and an inner roller which are forced at respective pressures to the outer roller through the belt. Pressure of the inner roller to the outer roller is adjusted to be greater than that of the heater to the outer roller.

10 Claims, 2 Drawing Sheets

BELT-TYPE FIXING DEVICE

FIELD OF THE INVENTION

The invention relates to an improved belt-type fixing device for use in an electrophotographic image forming apparatus as, for example, copy machine, printer, and facsimile. More especially, the invention relates to a belt-type fixing device having an endless belt by which an unfixed toner image is heated and then fixed on a sheet substrate such as paper. Further, the invention relates to a heating device for heating the endless belt.

BACKGROUND OF THE INVENTION

Typically, an electrophotographic image forming apparatus includes a fixing device by which a developing material, i.e., an unfixed toner image transferred onto a sheet substrate such as plain paper is heated and fixed on the sheet substrate. Accordingly, the image forming apparatus consumes a great deal of electric power at the fixing device. Especially, a heat-roller-type fixing device, comprising a pair of opposing rollers for nipping and transporting the sheet substrate while heating the toner image supported thereon, requires a relatively long time to heat them up to a desired temperature due to increased heat capacities of the rollers. This in turn requires the roller to be heated even in a standby state for a quick start of an initial image forming, which results in a remarkable power consumption.

To overcome this problem, in recent years, belt-type fixing devices have been provided in each of which a belt member having a relatively lower heat capacity is employed for heating and fusing the developer by the contact therewith.

Among others, one known belt-type fixing device includes a heater which is arranged inside the belt and a pressure roller which is arranged outside the same to oppose the heater, and the heater is forced against the pressure roller through the belt.

According to this fixing device, the heater should be forced against the belt and the pressure roller with a large force to prevent the pressure roller from slipping on the belt. The increased pressure will adversely results in remarkable wearing of a portion of the heater on which the belt is supported and an inner periphery of the belt contacting therewith, which decreasing durabilities of heater and belt. Particularly, this problem is serious in the belt-type fixing device in which one of opposing rollers arranged inside and outside the belt, respectively, is rotated firstly and thereby the belt and the other of the opposing rollers are driven to rotate due to a frictional force generated between the belt and the rollers.

SUMMARY OF THE INVENTION

Accordingly, the object of the invention is to provide an improved belt-type fixing device preferably employed in an electrophotographic image forming apparatus.

To this end, a belt-type fixing device of the invention comprises (a) an endless belt rotated by a driving source;

(b) an outer roller arranged outside the belt in contact with an outer periphery of the belt;

(c) a heater for heating the belt, the heater being arranged inside the belt and forced at a first pressure to the outer roller through the belt; and (d) an inner roller arranged inside the belt and forced at a second pressure to the outer roller through the belt, the second pressure being greater than the first pressure;

(f) wherein an unfixed image supported on a sheet is heated at a contact region between the belt and the outer roller by the belt which has been heated by the heater and then fixed onto the sheet.

According to the belt-type fixing device of the invention, because the inner roller, as well as the heater, is arranged inside the belt and further the pressure at which the inner roller is forced to the outer roller through the belt is set to be greater than the pressure at which the heater is forced to the outer roller through the belt, the outer roller is prevented from slipping on the belt mainly by the former pressure of the inner roller. Therefore, wearings both of the heater and the inner surface of the belt which contacts with the heater are decreased, and therefore they can be used for a long time.

BRIEF DESCRIPTION OF THE INVENTION

The object and feature of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

Figure 1:
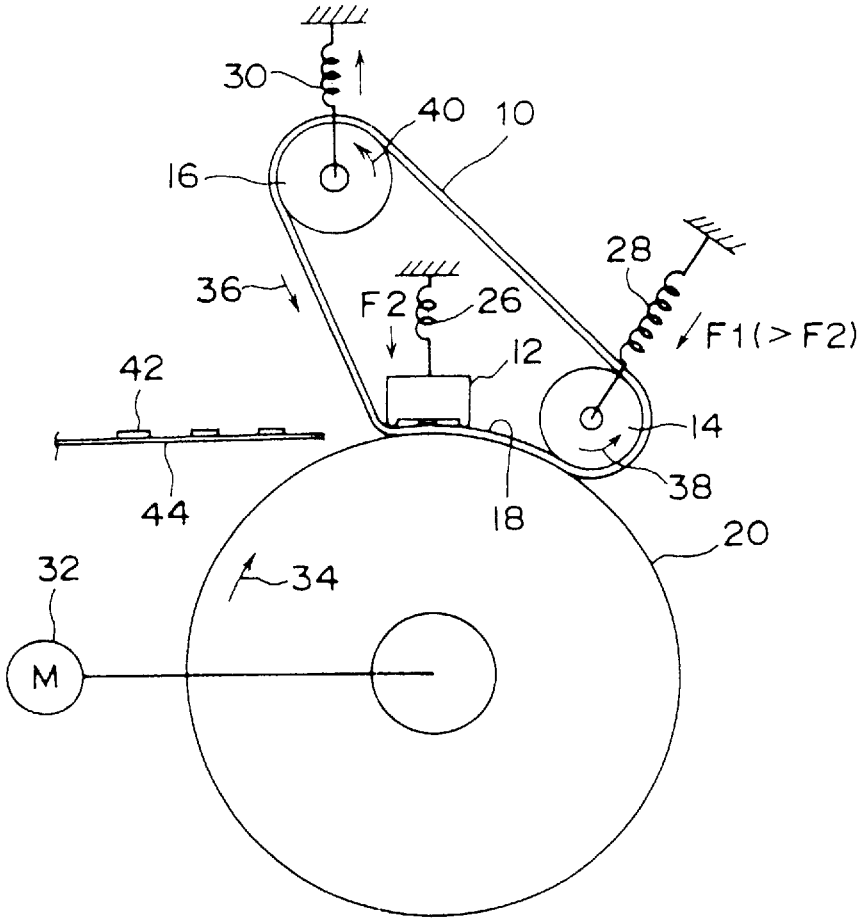
FIG. 1 is a side elevational view of a fixing device of the invention.

Referring to FIG. 1, there is shown a belt-type fixing device of the invention which includes an endless belt, generally indicated by reference numeral 10. The endless belt 10 is made from a thin film of a heat-resisting resin, for example, polyimide, or a metal, for example, stainless steel. Also, the belt 10 is supported at its inner periphery by a stationarily arranged heater 12, and rotatably mounted support roller 14 (i.e., inner roller) and tension roller 16, each arranged inside the belt 10. An outer periphery of a portion 18 in the belt 10, extended from the heater 12 to the support roller 14, is in circumferential contact with an outer periphery of a pressure roller 20 arranged outside the belt 10.

Figure 2:
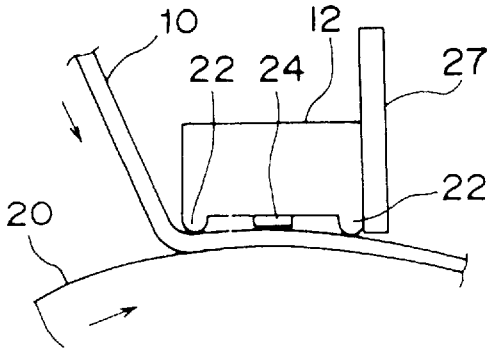
FIG. 2 is a enlarged side elevational view of a heater shown in FIG. 1.

As shown in detail in FIG. 2, the heater 12 comprises a pair of belt supports 22 for supporting the inner periphery of the belt 10 and a heat generator 24 arranged between the belt supports 22 to oppose the belt 10. Also, the heater 12 is forced outwardly towards the inner periphery of the belt 10 by a first spring 26 so that a portion of the belt 10 between the belt supports 22 is pressed onto an outer periphery of the pressure roller 20.

Preferably, a guide member 27 is provided adjacent the heater 12 which allows the heater 12 to move only to and from the pressure roller 20, but not move along the peripheral direction of pressure roller 20. In this embodiment, the guide member 27 is arranged to contact and guide one surface of the heater 12 positioned on the downstream side with respect to a rotational direction of the belt 10, however, it may also be arranged to contact with opposite surface of the heater 12.

Referring again to FIG. 1, the support roller 14 is forced towards the pressure roller 20 by a second spring 28 to press the pressure roller 20 through the belt 10. In this arrangement, a pressure F1 at which the support roller 14 is forced onto the belt 10 and the pressure roller 20 is designed to be greater than a pressure F2 at which the heater 12 is forced onto the same. Preferably, the pressure F1 is three or more kilograms while the pressure F2 is one or less kilogram. The tension roller 16 is forced outwardly towards the inner periphery of the belt 10 by a third spring 30 to provide the belt 10 with a suitable tension. The pressure roller 20 is drivingly connected with a drive motor 32 for rotation in a direction indicated by arrow 34.

With the fixing device so constructed, upon driving the motor 32, the pressure roller 20 is rotated in a direction of arrow 34. Then, the belt 10 is rotated in a direction of arrow 36 by a frictional force generated between the belt 10 and the pressure roller 20 due to the pressure F1 and F2. According to rotation of the belt 10, the support roller 14 and the tension roller 16 are rotated in respective directions indicated by arrows 38 and 40. Subsequently, the heat generator 24 radiates to heat the belt 10 when a certain voltage is applied thereto. When a sheet 44 bearing the developer (unfixed toner image) 42 is then entered into a contact region between the belt 10 and the pressure roller 20, both the developer 42 and the sheet 44 are heated by the belt 10, thereby the developer 42 is fused and then fixed onto the sheet 44.

In this fixing, successive portions of the inner surface of the belt 10 move into contact with the belt supports 22 of the heater 12, and therefore they will unavoidably be worn away by the repetition of the contact with the supports 22. In this embodiment, however, the pressure F2 of the heater 12 is adjusted to be lower, both wearings of the belt 10 and the supports 22 proceed very slowly. Therefore, periods in which the belt 10 and the heater 12 reach respective service lives due to their wearings will be extremely extended. Also, the portion 18 of the belt 10 supported on the heater 12 is always kept in contact with the outer periphery of the pressure roller 20. This ensure that the heat of the belt 10 is transmitted to the developer 42 and the sheet 44, thereby securing the fixing of the developer 42 onto the sheet 44. Because the pressure F1 of the support roller 14 is increased while the pressure F2 of the heater 12 is decreased, the rotation of the pressure roller 20 is fully transmitted to the belt 10 between the pressure roller 20 and the portion of the belt 10 opposed to the support roller 14, which prevents the belt 10 from slipping on the pressure roller 20.

Also, in the fixing device of this embodiment, the support roller 14 is arranged on a downstream side of the heater 12 with respect to a moving direction of the belt 10, i.e., a transporting direction of the sheet 44. The developer 42 on the sheet 44 is fused at the vicinity of the heater 12, and then pressed by the support roller 14 at the high pressure, allowing the developer 42 to be firmly fixed onto the sheet 44.

Figure 3:
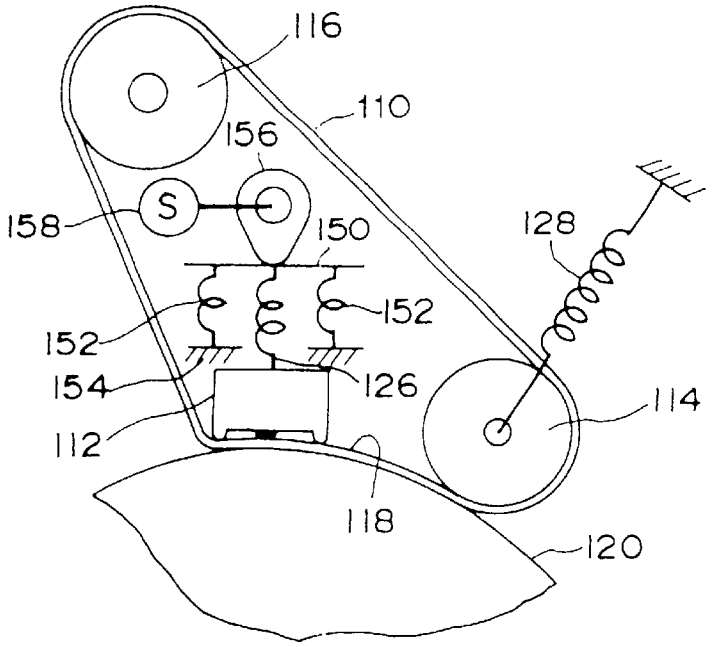
FIG. 3 is a partially side elevational view of another embodiment of the invention.
Figure 4:
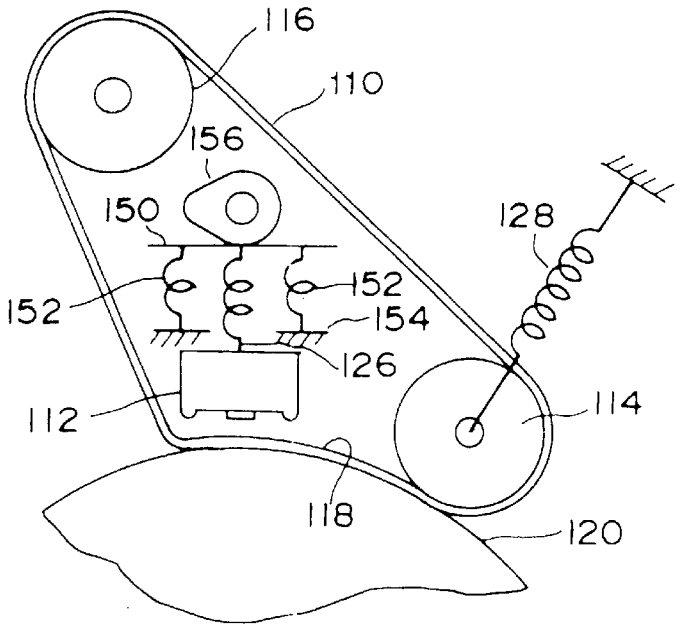
FIG. 4 shows a movable mechanism of the heater with FIG. 3.

FIGS. 3 and 4 show another embodiment of the invention in which like parts corresponding to those in FIG. 1 are designated by reference numerals to which one hundred are added, and therefore the descriptions therefor are omitted.

In this fixing device, one end of the first spring 126 which forces the heater 112 to the belt 110 and the pressure roller 120 is coupled to a movable member 150. The member 150 is supported by a plurality of springs 152 connected at their one ends with a body 154 of the fixing device. Also, a rotatable eccentric cam 156 drivingly connected with a solenoid 158 is arranged to contact at its outer periphery with the movable member 150 so that, by energizing and de-energizing the solenoid 158, the eccentric cam 156 can take a first position in which the heater 112 contacts with the belt 110 (see FIG. 3) and a second position in which the heater 112 is spaced away from the belt 110 (see FIG. 4). With this arrangement, if the belt 110 comes to a halt suddenly by an unwanted sheet jam or the like, the heater 112 is moved away from the belt 110 by the solenoid 158, preventing the specific portion 118 of the belt 110 from being heated by the heater 112 after the halt of the belt and thereby damaged. While the heater 112 is spaced away from the portion 118 of the belt 110, the belt 110 is still supported by the support and pressure rollers 114 and 120. Therefore, the belt 110 will not move unexpectedly in a transverse direction perpendicular to the rotational direction.

The invention has been disclosed in its most preferred embodiments, and it is clear that it is susceptible to numerous modifications and embodiments within the ability of those skilled in the art and without the exercise of the inventive faculty.

For example, an outer periphery of the support roller may be covered with an elastic material such as rubber, thereby preventing the image of developer from being flattened.

Also, in the above-described embodiments, the pressure roller is drivingly connected with the motor, however, the support roller and/or the tension roller supporting the belt may be drivingly connected with drive means, thereby rotating the pressure roller.

Further, the invention is not limited to the fixing device for fixing toner powder normally used in the electrophotographic image forming apparatus, but equally applied to fixing device for fixing other materials, such as, liquid toner, heat setting ink, and solid ink.

What is claimed is:

1. A belt-type fixing device for heating and fusing an unfixed image supported on a sheet and then fixing the image onto the sheet, comprising:

(a) an endless belt rotated by a driving source;

(b) an outer roller arranged outside said belt in contact with an outer periphery of said belt;

(c) a heater for heating said belt, said heater being arranged inside said belt and forced at a first pressure to said outer roller through said belt; and (d) an inner roller arranged inside said belt and forced at a second pressure to said outer roller through said belt, said second pressure being greater than said first pressure;

(f) wherein said unfixed image supported on said sheet is heated at a contact region between said belt and said outer roller by said belt which has been heated by said heater and then fixed onto said sheet.

2. A belt-type fixing device claimed in claim 1, wherein said heater stationarily contacts with said belt while said belt moves in contact with said heater.

3. A belt-type fixing device claimed in claim 1, wherein said inner roller is arranged on a downstream side of said heater with respect to a rotational direction of said belt.

4. A belt-type fixing device claimed in claim 1, wherein said second pressure of said inner roller is three or more kilograms while said first pressure of said heater is one or less kilogram.

5. A belt-type fixing device claimed in claim 1, further comprising a mechanism which moves said heater away from said belt when said belt is halted.

6. A heating device for heating an endless belt, comprising:

(a) an endless belt rotated by a driving source;

(b) an outer roller arranged outside said belt in contact with an outer periphery of said belt;

(c) a heater for heating said belt, said heater being arranged inside said belt and forced at a first pressure to said outer roller through said belt; and (d) an inner roller arranged inside said belt and forced at a second pressure to said outer roller through said belt, said second pressure being greater than said first pressure.

7. A heating device claimed in claim 6, wherein said heater stationarily contacts with said belt while said belt moves in contact with said heater.

8. A heating device claimed in claim 6, wherein said inner roller is arranged on a downstream side of said heater with respect to a rotational direction of said belt.

9. A heating device claimed in claim 6, wherein said second pressure of said inner roller is three or more kilograms while said first pressure of said heater is one or less kilogram.

10. A heating device claimed in claim 6, further comprising a mechanism which moves said heater away from said belt when said belt is halted.

* * * * *